US011283190B2

(12) United States Patent
Timmins et al.

(10) Patent No.: US 11,283,190 B2
(45) Date of Patent: Mar. 22, 2022

(54) ACTIVE FIXED BEAM ANTENNA ARRAY

(71) Applicant: AvL Technologies, Inc., Asheville, NC (US)

(72) Inventors: Ian J. Timmins, Asheville, NC (US); Keith Edenfield, Weaverville, NC (US); Bruce Barratt, Sheville, NC (US); Alan Ellis, Candler, NC (US)

(73) Assignee: AvL Technologies, Inc., Asheville, NC (US)

( * ) Notice: Subject to any disclaimer, the term of this patent is extended or adjusted under 35 U.S.C. 154(b) by 373 days.

(21) Appl. No.: 16/180,895

(22) Filed: Nov. 5, 2018

(65) Prior Publication Data

US 2019/0157772 A1 May 23, 2019

Related U.S. Application Data

(60) Provisional application No. 62/581,168, filed on Nov. 3, 2017.

(51) Int. Cl.

| | |
|---|---|
| ***H01Q 1/22*** | (2006.01) |
| ***H01Q 23/00*** | (2006.01) |
| ***H01Q 1/52*** | (2006.01) |
| ***H01Q 9/04*** | (2006.01) |
| ***H01Q 1/28*** | (2006.01) |
| ***H01Q 21/06*** | (2006.01) |

(Continued)

(52) U.S. Cl.

CPC ..... *H01Q 21/065* (2013.01); *H01Q 1/22* (2013.01); *H01Q 1/28* (2013.01); *H01Q 1/288* (2013.01); *H01Q 1/38* (2013.01); *H01Q 1/40* (2013.01); *H01Q 1/52* (2013.01); *H01Q 1/523* (2013.01); *H01Q 9/04* (2013.01); *H01Q 9/0407* (2013.01); *H01Q 23/00* (2013.01); *H01Q 25/007* (2013.01)

(58) Field of Classification Search

CPC .... H01Q 21/065; H01Q 9/0407; H01Q 1/288; H01Q 1/523; H01Q 1/22; H01Q 23/00; H01Q 1/40; H01Q 1/52; H01Q 9/04; H01Q 1/28

USPC ..... 343/893

See application file for complete search history.

(56) References Cited

U.S. PATENT DOCUMENTS 6,249,242 B1 * 6/2001 Sekine ..... G01S 7/032 342/175

9,485,009 B1 * 11/2016 Shemesh ..... H04B 7/18508

(Continued)

*Primary Examiner* — Hai V Tran

(74) *Attorney, Agent, or Firm* — William G. Heedy; The Van Winkle Law Firm

(57) ABSTRACT

A fixed beam high gain antenna for generating high gain for satellite communication ground terminals includes a multi-layer PCB having a top surface forming a rear surface of the antenna and a bottom layer forming a front surface of the antenna; an antenna array including a plurality of antenna patches on the front surface of the antenna and a plurality of application-specific integrated circuits (ASICs) on the rear surface of the antenna; wherein the antenna array comprises at least one antenna unit cell each including one of the plurality of ASICs in connection with a corresponding plurality of the plurality of antenna patches; wherein each one of the plurality of ASICs is centrally positioned and surrounded by the corresponding plurality of antenna patches; and wherein a reduced length of the connection between each of the plurality of ASICs and the corresponding plurality of antenna patches minimizes RF transmission loss.

10 Claims, 6 Drawing Sheets

(51) Int. Cl.

| | |
|---|---|
| ***H01Q 1/40*** | (2006.01) |
| ***H01Q 1/38*** | (2006.01) |
| ***H01Q 25/00*** | (2006.01) |

(56) References Cited

U.S. PATENT DOCUMENTS

| | | | | |
|---|---|---|---|---|
| 2006/0077102 | A1* | 4/2006 | Mohamadi | H01Q 21/0006 343/700 MS |
| 2009/0251357 | A1* | 10/2009 | Margomenos | G01S 13/931 342/70 |
| 2009/0315797 | A1* | 12/2009 | Rofougaran | H01Q 9/0407 343/787 |
| 2019/0044251 | A1* | 2/2019 | McMorrow | H01Q 21/065 |
| 2019/0252757 | A1* | 8/2019 | Baek | H04M 1/02 |

* cited by examiner

ACTIVE FIXED BEAM ANTENNA ARRAY

RELATED APPLICATION

This application claims priority to and incorporates entirely by reference U.S. Provisional Patent Application Ser. No. 62/581,168 filed on Nov. 3, 2017.

FIELD OF THE INVENTION

This invention relates to a fixed beam high gain antenna array containing antenna patches and integrated circuits (ICs) within which solid-state power amplifiers (SSPAs) are embedded. Particularly, this invention presents an array in which the antenna patches (TX and RX patches) are located on one side of the printed circuit board (PCB), while their corresponding application-specific integrated circuits (ASICs) are located on the opposite side of the PCB. Thus, the antenna patches can be arranged as close as possible to each other and generate high gain at a fixed beam.

BACKGROUND OF THE INVENTION

A fixed beam antenna is a directional antenna steered to one desired direction, ideally generating the highest gain in the main lobe without any side lobes. For satellite communications, the ordinary dielectric material, such as RF4, cannot meet the requirement for radio frequency (RF) transmission due to non-negligible loss at high frequency. Even if specialized high-frequency dielectric material is used for RF feed, the RF transmission loss is noticeable, particularly at Ka band frequencies (20-30 GHz).

There exists a need to reduce the RF transmission loss for satellite communication at Ka band. This invention presents a fixed beam active antenna array in which one RX patch interleaves with four TX patches which are placed as close as possible to the one RX patch. The TX and RX patches share a common aperture and generate a high gain fixed beam that is merged from TX and RX beams. The antenna boresight of the fixed beam is normal to the flat antenna surface.

SUMMARY OF THE INVENTION

In accordance with one form of the present invention, there is provided a fixed beam high gain antenna for generating high gain for satellite communication ground terminals, the antenna including a multi-layer printed circuit board (PCB) having a top surface forming a rear surface of the antenna and a bottom layer forming a front surface of the antenna; an antenna array including a plurality of antenna patches on the front surface of the antenna and a plurality of application-specific integrated circuits (ASICs) on the rear surface of the antenna; wherein the antenna array comprises at least one antenna unit cell each including one of the plurality of ASICs in connection with a corresponding plurality of the plurality of antenna patches; wherein each one of the plurality of ASICs is centrally positioned and surrounded by the corresponding plurality of antenna patches; and wherein a reduced length of the connection between each of the plurality of ASICs and the corresponding plurality of antenna patches minimizes radio frequency (RF) transmission loss.

In accordance with another form of the present invention, there is provided a fixed beam high gain antenna for generating high gain for satellite communication ground terminals, the antenna including a multi-layer printed circuit board (PCB) having a top surface forming a rear surface of the antenna and a bottom layer forming a front surface of the antenna; a plurality of TX patches and a plurality of RX patches on the front surface of the antenna; a plurality of TX application-specific integrated circuits (ASICs) and a plurality of RX ASICs on the antenna rear surface; an antenna array including a plurality of TX patches and a plurality of RX patches on the front surface of the antenna and a plurality of TX application-specific integrated circuits (ASICs) and a plurality of RX ASICs on the rear surface of the antenna; wherein the antenna array comprises at least one TX unit cell each including one of the plurality of TX ASICs in connection with a corresponding four of the plurality of TX patches and an RX unit cell each including one of the plurality of RX ASICs in connection with a corresponding four of the plurality of RX patches; wherein each one of the plurality of TX ASICs is centrally positioned and surrounded by the corresponding four TX patches and each one of the plurality of RX ASICs is centrally positioned and surrounded by the corresponding four RX patches; and wherein a reduced length of the connection between each of the plurality of TX ASICs and the corresponding plurality of TX patches and between each of the plurality of RX ASICs and the corresponding plurality of RX patches minimizes RF transmission loss.

In accordance with another form of the present invention, there is provided a fixed beam high gain antenna for generating high gain for satellite communication ground terminals, the antenna including a multi-layer printed circuit board (PCB) having a top surface forming a rear surface of the antenna and a bottom layer forming a front surface of the antenna; a hybrid antenna array including a plurality of TX patches and a plurality of RX patches on the front surface of the antenna and a plurality of TX application-specific integrated circuits (ASICs) and a plurality of RX ASICs located on the rear surface of the antenna; wherein each of the plurality of RX patches on the front surface of the antenna is centrally positioned and surrounded by four TX patches on the front surface of the antenna; wherein each of the plurality of TX ASICs on the rear surface of the antenna is surrounded by and in connection with a corresponding four TX patches of the plurality of TX patches on the front surface of the antenna; wherein each of the plurality of RX ASICs on the rear surface of the antenna is surrounded by and in connection with a corresponding four RX patches of the plurality of RX patches on the front surface of the antenna; and wherein a first reduced length of the connection between each one of the plurality of TX ASIC and the corresponding four TX patches and a second reduced length of the connection between each one of the plurality of RX ASIC and the corresponding four RX patches minimizes RF transmission loss.

BRIEF DESCRIPTION OF THE DRAWINGS

For a fuller understanding of the nature of the present invention, reference should be made to the following detailed description, taken in conjunction with the accompanying drawings in which.

The detailed embodiments of the present invention will hereinafter be described in conjunction with the appended drawings.

DETAILED DESCRIPTION OF THE PREFERRED EMBODIMENTS

In the present invention, a novel fixed beam high gain antenna array composed of antenna patches and their corresponding application-specific integrated circuits (ASICs) is utilized to generate high gain of a fixed beam for satellite communication ground terminals. The antenna patches include TX and RX patches that are located within the bottom layer of a multi-layer printed circuit board (PCB). The corresponding TX and RX ASICs are located on the top surface of the PCB. Four antenna patches are connected to one corresponding ASIC through PCB transmission lines and signal vias, forming one unit cell. In one preferred embodiment, the ratio of TX to RX patches is 4:1. Within the bottom layer of the PCB, one RX patch is surrounded by four TX patches and the four TX patches are placed as close as possible to the one RX patch. Additionally, one TX ASIC located on the top surface of the PCB corresponds to four TX patches within the bottom layer of the PCB, forming a TX unit cell. Likewise, one RX ASIC located on the top surface of the PCB corresponds to four RX patches that are surrounded by sixteen TX patches within the bottom layer of the PCB, forming a RX unit cell which resides in the middle of four TX unit cells. As a result, a hybrid unit cell contains four TX unit cells and one RX unit cells. In other word, a hybrid unit cell includes four TX ASICs and one RX ASICs that correspond to sixteen TX patches and four RX patches, respectively. In such a hybrid unit cell, TX patches can be placed as close as possible to RX patches on the top surface of the PCB, and the corresponding TX ASICs can be placed as close as possible to RX ASICs within the bottom layer of the PCB. Such close proximities enhance the interleaving between the TX and RX patches and corresponding TX ASICs and RX ASICs. At the same time, the close proximities between the TX and RX patches and between the TX ASICs and RX ASICs reduce the required length of the PCB transmission lines and the required length of the signal vias. Such reductions result in a significant decrease in the satellite transmission loss and a high gain at a fixed beam.

Figure 1:
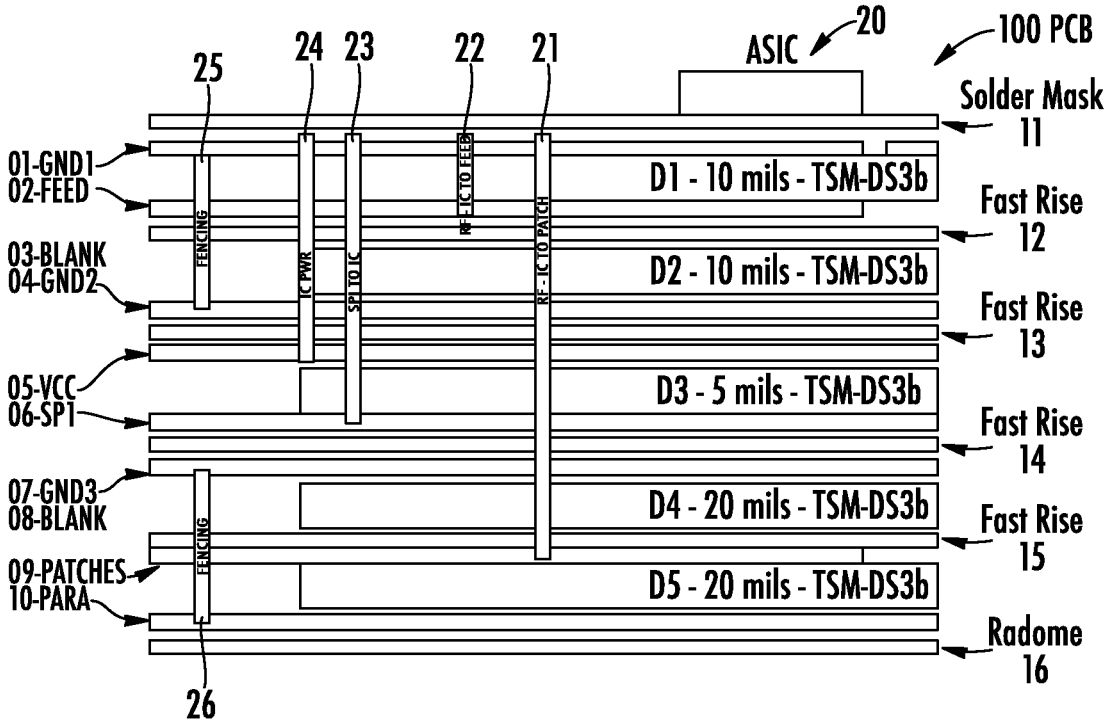
FIG. 1 illustrates a cross sectional view of a printed circuit board (PCB) with application-specific integrated circuits (ASICs) on the top surface of the PCB and antenna patches within the bottom layer of the PCB.

Referring initially to FIG. 1, an exemplified cross-sectional view of a multi-layer PCB 100 is shown. On the top layer of the PCB 100 there is a solder mask 11 on which the application-specific integrated circuits (ASICs) 20 is printed. Underneath the bottom layer of the PCB 100 there exists a radome 16 which protects the antenna patches and parasitic patches located within the bottom layer of the PCB 100 during manufacturing. In one embodiment, the PCB 100 is divided into five layers by four fast rise sublayers 12, 13, 14, and 15. On the tops and at the bottoms of these five layers there exist ten sublayers: the first sublayer is a first ground plane (GND1) 01; the second sublayer is a feed sublayer 02; the third sublayer is blank 03 (no sublayer); the fourth sublayer is a second ground plane (GND2) 04; the fifth sublayer is voltage at the common collector (VCC) 05; the sixth sublayer is a serial peripheral interface (SPI) 06; the seventh sublayer is a third ground plane (GND3) 07; the eighth sublayer is blank 08 (no sublayer); the ninth sublayer is antenna patches 09; the tenth sublayer is parasitic patches 10. Within each layer, there is a middle sublayer made of specialized high-frequency dielectric material. In one embodiment, the dielectric material of the middle sublayer is TSM-DS3. In the other embodiment, the height of these five middle sublayers from top to bottom are 10 mils, 10 mils, 5 mils, 20 mils and 20 mils, respectively. Here, the illustrated heights of the dielectric sublayers are not limiting, but adaptable as needed for the PCB design.

The dielectric materials for the middle sublayers are selective. In one embodiment, the dielectric material is RF4 for the VCC and SPI sublayers, providing the digital function. In the other embodiment, the dielectric material is selected from Rogers 3003, 3035, 3006 or equivalents for radio frequency (RF) feed sublayer. The RF feed sublayer can be an RF TX feed sublayer, an RF RX feed sublayer, or a couple of RF TX and RX feed sublayers. The RF feed sublayer contains power dividers and respective resistive foil, applied with direct currency (DC) power between the VCC and the DC GND sublayers. The use of Rogers 3003 and its equivalent dielectric materials for the RF feed sublayer results in a low loss feeding network and maximizes the antenna transmission performance. In some embodiments, there are multiple vias through a number of PCB layers and/or sublayers of the PCB 100. As exemplified in FIG. 1, there are four signal vias: (1) the via 21 connecting the RF-integrated circuits (IC) to the antenna patches, (2) the via 22 connecting the RF-IC to the feed sublayer, (3) the via 23 connecting the RF-IC to the SPI sublayer, and (4) the via 25 connecting the RF-IC to the power, i.e. the VCC sublayer. In other embodiments, there are two fencing vias 25 and 26 that pass through the top two layers and the bottom two layers, respectively, for eliminating the loss of the propagated energy.

Figure 2:
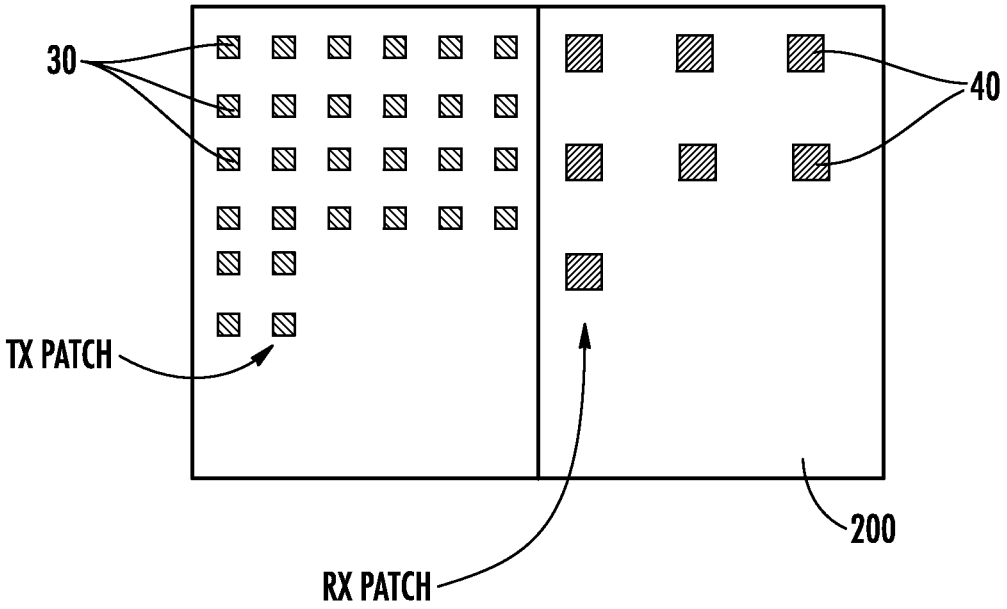
FIG. 2 illustrates an array of TX and RX patches separated into two independent assemblies on the antenna front surface.

Referring to FIG. 2, there is an array of TX and RX patches in which TX and RX patches are separated into two independent assemblies. All TX patches 30 are on the left side of the antenna front surface 200 toward the radiation direction, i.e. within the bottom layer of the PCB. Alternatively, all RX patches 40 are on the right side of the antenna front surface 200 toward the radiation direction. In one embodiment, the shape of the TX and RX patches is square, as shown in the FIG. 2. In some other embodiments, the shape of the TX and RX patches is circle-like or rectangle-like. In the array shown in FIG. 2, every four TX patches 30 on the antenna front surface 200 correspond to one TX ASIC on the antenna rear surface (not shown). Likewise, every four RX patches 30 on the antenna front surface 200 correspond to one RX ASIC on the antenna rear surface (not shown). In one embodiment, the two independent assemblies of TX and RX patches 30 and 40 on the antenna front surface 200 are within the bottom layer of one PCB. In the other embodiment, the two independent assemblies of TX and RX patches 30 and 40 on the antenna front surface 200 are within the bottom layers of two PCBs juxtaposed together. In either embodiment, TX patches 30 and RX patches 40 have separate apertures and they will radiate into two beams.

Figure 3:
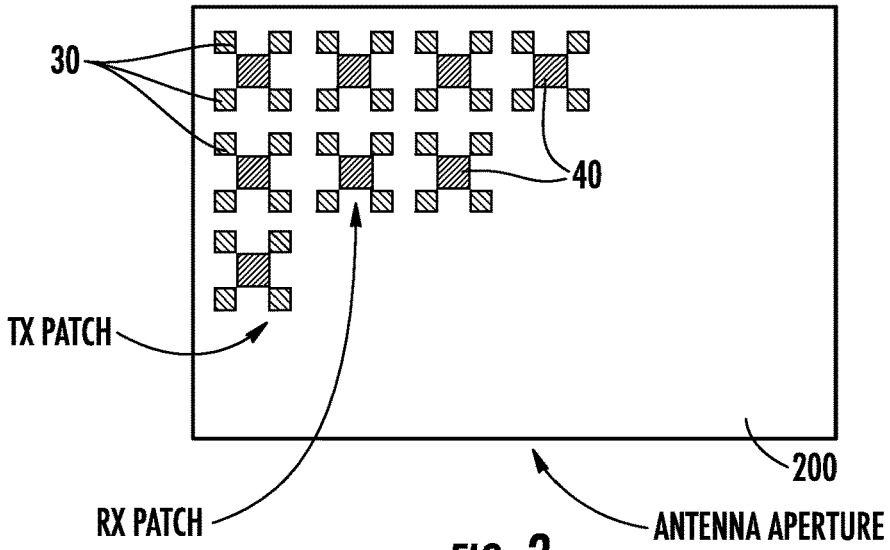
FIG. 3 illustrates an array of TX and RX patches that are placed as close as possible to each other on the antenna front surface and share a same aperture.

FIG. 3 shows a hybrid array in which TX and RX patches are placed as close as possible to each other. Specifically, four TX patches 30 surround one RX patch 40, and such a pattern of four TX patches 30 and one RX patch 40 is repeatedly positioned on the antenna front surface 200 in rows and columns. In the hybrid array shown in FIG. 3, every four TX patches 30 on the antenna front surface 200 correspond to one TX ASIC (not shown) on the antenna rear surface. Four TX patches 30 and one corresponding TX ASIC constitute a TX unit cell. Likewise, every four RX patches 40 on the antenna front surface 200 correspond to one RX ASIC (not shown) on the antenna rear surface. Four RX patches 40 and one corresponding RX ASIC constitute an RX unit cell. As a result, a hybrid unit cell of the hybrid array contains one RX unit cell residing in the middle of four TX unit cells, including sixteen TX patches and four RX patches on the antenna front surface 200, and four corresponding TX ASICs and one corresponding RX ASIC on the antenna rear surface. In the hybrid array shown in FIG. 3, TX patches 30 and RX patches 40 share the same aperture and they will radiate into one beam, i.e. TX and RX beams being merged into one beam.

Figure 4A:
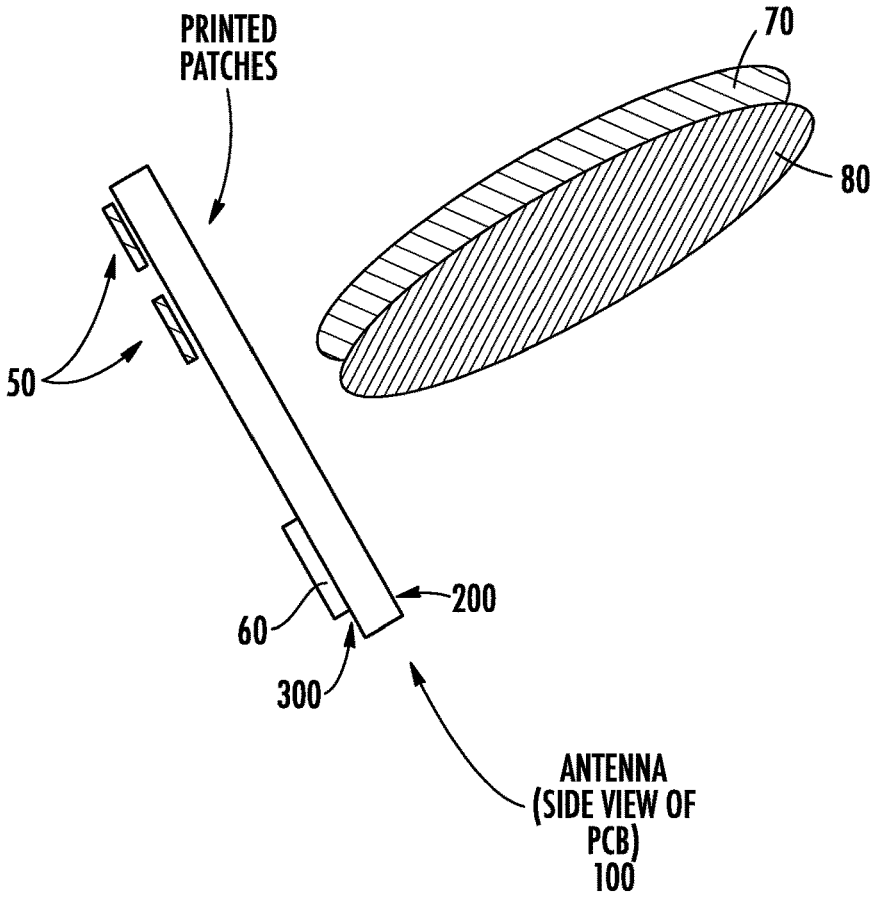
FIG. 4(A) illustrates a generated radiation pattern of TX and RX beams from the interleaved TX and RX patches separated into two independent assemblies.
Figure 4B:
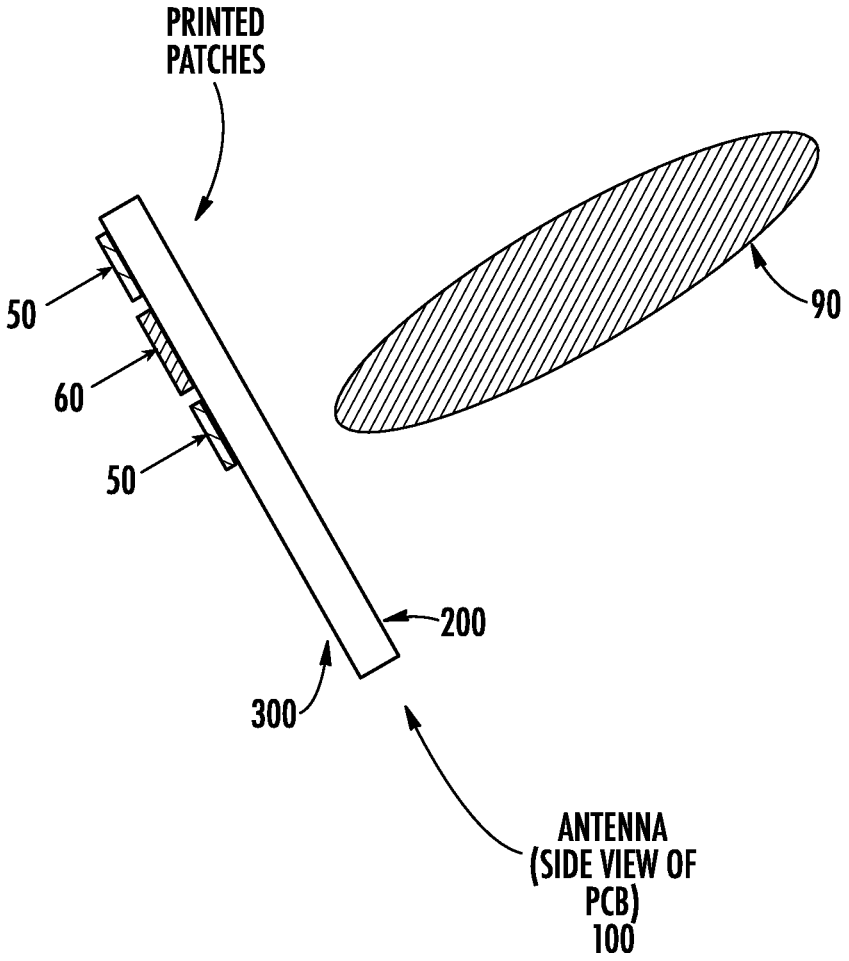
FIG. 4(B) illustrates a generated radiation pattern of TX and RX beams from the interleaved TX and RX patches in close proximities and share the same aperture.

Referring now to FIGS. 4(*a*) and 4(*b*), FIG. 4(*a*) illustrates the TX and RX beams 70 and 80 radiated from an array that TX and RX patches are separated into two independent assemblies (as shown in FIG. 2), and FIG. 4(*b*) illustrates the TX and RX beams radiated from a hybrid array that TX and RX patches are placed as close as possible (as shown as in FIG. 3). In FIG. 4, the antenna is the PCB 100 in its side view without demonstrating specific layers and sublayers. It is worth to note that the antenna patches, TX and RX patches, are on the antenna front surface 200 within the bottom layer of the PCB 100, which the TX ASICs and RX ASICs are on the antenna rear surface 300, i.e. on the top surface of the PCB 100.

In FIG. 4(*a*), the TX and RX patches 30 and 40 separated into two independent assemblies are located on the antenna front surface 200 (not shown), and within the bottom layer of the PCB 100 (shown in FIG. 1). The corresponding TX ASICs 50 and RX ASICs 60 are also separated into two independent assemblies, located on the antenna rear surface 300, i.e. on the top surface of the PCB 100 (shown in FIG. 2). Due to the separation between TX and RX patches on the antenna front surface 200 and separation between TX ASICs and RX ASICs on the antenna rear surface 300, there are two separate apertures required. The interleaving between TX and RX patches and between corresponding TX ASICs and RX ASICs results in two TX and RX beams 70 and 80. Alternatively, in FIG. 4(*b*), the TX and RX patches in the hybrid array are placed as close as possible to RX patches 40 to each other on the antenna front surface 200. On the antenna rear surface 300, the corresponding TX and RX ASICs in the hybrid array are also as close as possible to each other on the antenna rear surface 300. In one embodiment, the ratio of the numbers of the TX patches 30 and RX patches 40 and that of TX ASICs 50 and RX ASICs 60 is 4:1. Due to the close proximities between antenna patches and their corresponding ASICs, the TX and RX patches share a same aperture, and the interleaving between TX and RX patches and between corresponding TX ASICs and RX ASICs results in one beam 90, merged from the TX and RX beams 70 and 80. Thus, the fixed beam antenna with the hybrid array of TX and RX patches has a double-sized gain of that with the separate arrays of TX and RX patches.

Figure 5:
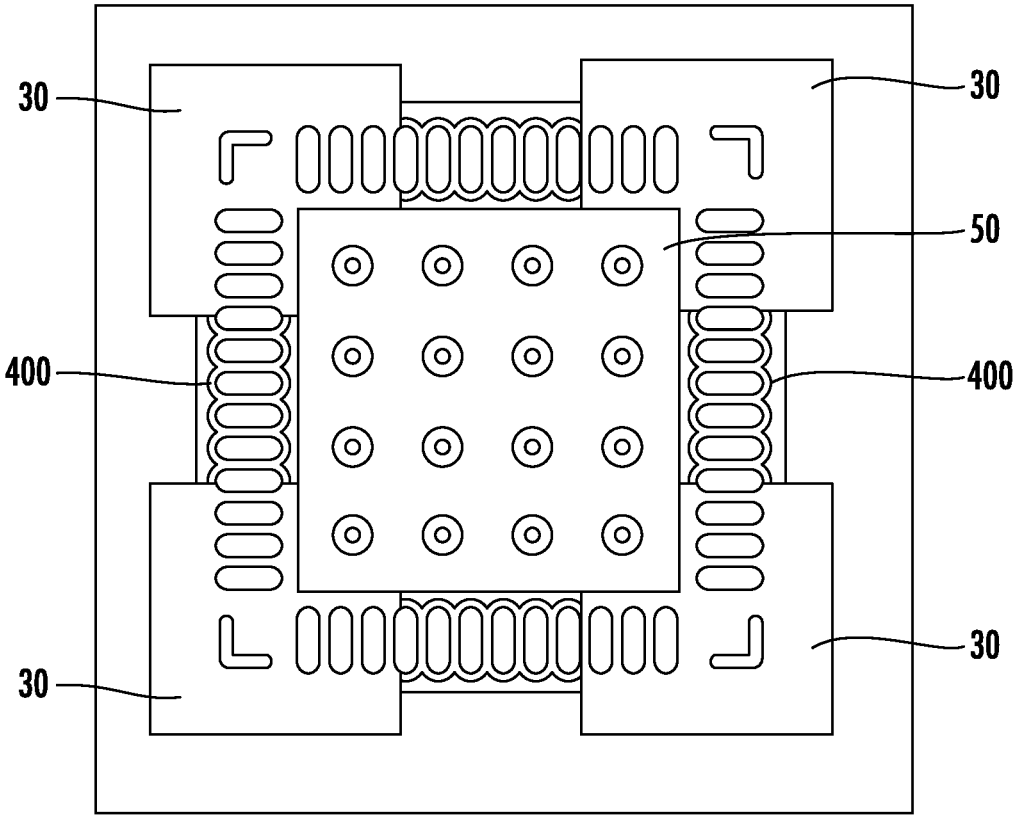
FIG. 5 illustrates a TX unit cell including four TX patches on the antenna front surface and one corresponding TX ASIC on the antenna rear surface.
Figure 6:
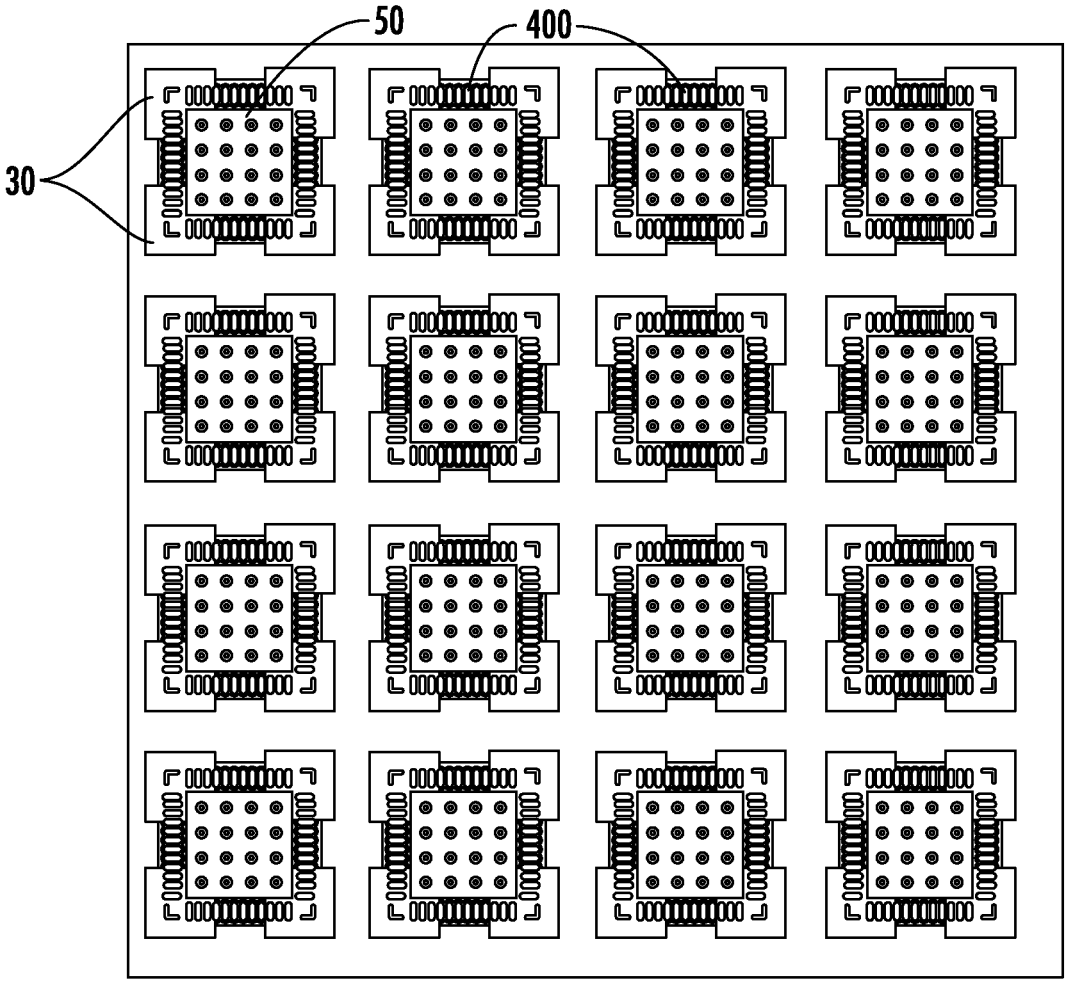
FIG. 6 illustrates an array of multiple TX unit cells on the antenna in which all TX patches on the antenna front surface and all corresponding TX ASICs on the antenna rear surface.

FIG. 5 illustrates a TX unit cell including four TX patches 30 on the antenna front surface and one corresponding TX ASIC 50 on the antenna rear surface. In other word, four TX patches are located within the bottom layer of the PCB and the corresponding TX ASIC 50 is printed on the top surface of the PCB. The TX ASIC 50 is printed on the PCB through the integrated circuit footprint 400. Since four TX patches and the corresponding TX ASIC are located on the opposite sides of the PCB, the four TX patches and the TX ASIC are "stacked up" with the PCB stackup "sandwiched" in between. In such a compact configuration of the TX unit cell, the connection length between the four TX patches and the TX ASIC is minimized. The required transmission lines are short on both PCB layers on which the input and output transmission lines are. The required signal vias are short running through a number of PCB layers as needed. Thus, the transmission loss due to the long connections array is reduced. FIG. 6 illustrates an array of sixteen TX unit cells positioned in four rows and four columns. The four smaller squares are TX patches 30, surrounding a bigger square that is the corresponding TX ASIC 50. In some embodiments, these sixteen TX unit cells are placed in an assembly separated from the assembly of the RX unit cells. In other embodiments, these sixteen TX unit cells are within a hybrid array in which four RX unit cells residing among these sixteen TX unit cells.

Figure 7:
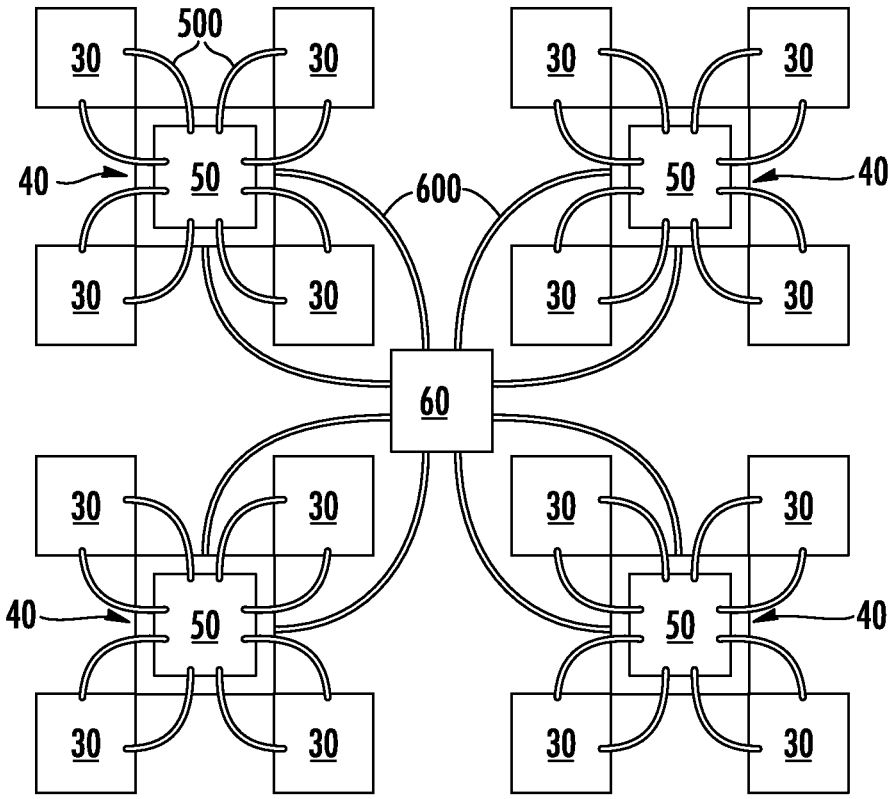
FIG. 7 illustrates a hybrid unit cell including sixteen TX patches and four RX patches on the antenna front surface and four corresponding TX ASICs and one corresponding RX ASIC on the antenna rear surface.

FIG. 7 illustrates a hybrid unit cell including sixteen TX patches and four RX patches on the antenna front surface and four corresponding TX ASICs and one corresponding RX ASIC on the antenna rear surface. In the hybrid unit cell, the ratio of the number of TX to RX patches is 4:1. The ratio of the number of the corresponding TX ASICs to RX ASICs is also 4:1. The hybrid unit cell contains four TX unit cells and one RX unit cell. Each TX unit cell contains four TX patches 30 and one TX ASIC 50, in which the four TX patches 30 are located on the antenna front surface and the TX ASIC 50 is located on the antenna rear surface. Although the TX patches 30 and TX ASIC 50 are not on the same plane, the corresponding TX ASIC 50 is positioned in the center of the four TX patches 30. Likewise, the RX unit cell contains four RX patches 40 and one RX ASIC 60, in which the four RX patches 40 are located on the antenna front surface and the RX ASIC 60 is located on the antenna rear surface. The same as the configuration in the TX unit cell, the corresponding RX ASIC 60 is positioned in the center of the four RX patches 40 in the RX unit cell, although they are not on the same plane. As exemplified in FIG. 7, four TX patches 30 surrounding one RX patch 40 on the same plane, i.e. the antenna front surface. The corresponding TX ASIC 50 is positioned in the center of four TX patches 30 even if they are on two different planes, i.e. the antenna rear and front surfaces. As a result, the RX patch 40 surrounding the four TX patches 30 and the corresponding TX ASIC 50 of the four TX patches 30 are "stacked up" with the PCB "sandwiched" in between. Such four RX patches 40 and its corresponding RX ASIC 60 are located on the antenna front and rear surface respectively and constitute an RX unit cell. The corresponding RX ASIC 60 is positioned in the center of the four RX patches 40, i.e. the center of the four TX unit cells or the center of the sixteen TX patches. As such, four TX unit cells and one RX unit cell constitutes a hybrid unit cell, containing sixteen TX patches 30 and four RX patches 40 on the antenna front surface and four corresponding TX ASICs 50 and one corresponding RX ASIC 60 on the antenna rear surface.

Due to the close proximities between the TX patches 30 on the antenna front surface and the TX ASIC 50 on the antenna rear surface, the connection between the TX patches 30 and TX ASIC 50 is minimized. As shown in FIG. 7, there are two connection lines 500 between each TX patch and its corresponding TX ASIC. Each connection line 500 includes PCB transmission lines and signal vias passing through a number of PCB layers. Likewise, there are two connection lines 600 between each RX patch and its corresponding RX ASIC. Each connection line 600 also includes PCB transmission lines and signal vias passing through a number of PCB layers. This hybrid antenna array contains one RX unit cell residing inside of four TX unit cells, resulting in close proximities between TX and RX patches, between antenna patches and ASICs, and between TX ASICs and RX ASICs. Such close proximities have three advantages for generating high gain at a fixed beam. First, the solid-state power amplifiers (SSPAs) are embedded in the TX and RX ASICs which are within the close proximities of the antenna patches. The close proximities enhance the interleaving between the TX and RX patches and between the corresponding TX ASICs and RX ASICs. Second, the proximities between the antenna patches and their corresponding ASICs reduced the required length of the PCB transmission lines. The reduction in the length of the transmission lines results in reduction of the transmission loss. Third, the length of the signal via is short when the via connects the TX and/or RX feed sublayer to the TX and/or RX ASICs and then to the individual antenna patch. The reduction in the length of the signal vias contributes to decreased transmission loss and improved the transmission performance.

While the present invention has been shown and described in accordance with several preferred and practical embodiments, it is recognized that departures from the instant disclosure are contemplated within the spirit and scope of the present invention.

What is claimed is:

1. A fixed beam high gain antenna for generating high gain for satellite communication ground terminals, the antenna comprising:

a multi-layer printed circuit board (PCB) having a top surface forming a rear surface of the antenna and a bottom layer forming a front surface of the antenna;

a plurality of TX patches and a plurality of RX patches on the front surface of the antenna;

a plurality of TX application-specific integrated circuits (ASICs) and a plurality of RX ASICs on the antenna rear surface;

an antenna array including a plurality of TX patches and a plurality of RX patches on the front surface of the antenna and a plurality of TX application-specific integrated circuits (ASICs) and a plurality of RX ASICs on the rear surface of the antenna;

wherein the antenna array comprises at least one TX unit cell each including one of the plurality of TX ASICs in connection with a corresponding four of the plurality of TX patches and an RX unit cell each including one of the plurality of RX ASICs in connection with a corresponding four of the plurality of RX patches;

wherein each one of the plurality of TX ASICs is centrally positioned and surrounded by the corresponding four TX patches and each one of the plurality of RX ASICs is centrally positioned and surrounded by the corresponding four RX patches; and wherein a reduced length of the connection between each of the plurality of TX ASICs and the corresponding plurality of TX patches and between each of the plurality of RX ASICs and the corresponding plurality of RX patches minimizes RF transmission loss.

2. The fixed beam high gain antenna as recited in claim 1, wherein the plurality of TX patches and the plurality of RX patches each have a separate aperture.

3. The fixed beam high gain antenna as recited in claim 1, wherein the one TX ASIC is connected to the four TX patches through PCB transmission lines and signal vias.

4. The fixed beam high gain antenna as recited in claim 1, wherein each of the plurality of RX ASICs is connected to the corresponding four RX patches through PCB transmission lines and signal vias.

5. A fixed beam high gain antenna for generating high gain for satellite communication ground terminals, the antenna comprising:

a multi-layer printed circuit board (PCB) having a top surface forming a rear surface of the antenna and a bottom layer forming a front surface of the antenna;

a hybrid antenna array including a plurality of TX patches and a plurality of RX patches on the front surface of the antenna and a plurality of TX application-specific integrated circuits (ASICs) and a plurality of RX ASICs located on the rear surface of the antenna;

wherein each of the plurality of RX patches on the front surface of the antenna is centrally positioned and surrounded by four TX patches on the front surface of the antenna;

wherein each of the plurality of TX ASICs on the rear surface of the antenna is surrounded by and in connection with a corresponding four TX patches of the plurality of TX patches on the front surface of the antenna;

wherein each of the plurality of RX ASICs on the rear surface of the antenna is surrounded by and in connection with a corresponding four RX patches of the plurality of RX patches on the front surface of the antenna; and where in a first reduced length of the connection between each one of the plurality of TX ASIC and the corresponding four TX patches and a second reduced length of the connection between each one of the plurality of RX ASIC and the corresponding four RX patches minimizes RF transmission loss.

6. The fixed beam high gain antenna as recited in claim 5, wherein the plurality of TX patches and the plurality of RX patches share a common aperture.

7. The fixed beam high gain antenna as recited in claim 5, wherein at least one TX ASIC in connection with the corresponding four TX patches and at least one RX patch surrounded by the corresponding four TX patches are "stacked up" with the PCB in between.

8. The fixed beam high gain antenna as recited in claim 5, wherein at least one RX ASIC is centrally positioned and surrounded by the corresponding four RX patches each of which is surrounded by the four TX patches.

9. The fixed beam high gain antenna as recited in claim 5, wherein each of the plurality of TX ASICs is connected to the corresponding four TX patches through PCB transmission lines and signal vias.

10. The fixed beam high gain antenna as recited in claim 5, wherein each of the plurality of RX ASICs is connected to the corresponding four RX patches through PCB transmission lines and signal vias.

* * * * *